US008668439B2

(12) United States Patent
Willett, Jr.

(10) Patent No.: US 8,668,439 B2
(45) Date of Patent: Mar. 11, 2014

(54) INSERTS FOR TURBINE COOLING CIRCUIT

(75) Inventor: Fred Thomas Willett, Jr., Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 463 days.

(21) Appl. No.: 13/071,131

(22) Filed: Mar. 24, 2011

(65) Prior Publication Data

US 2012/0244009 A1 Sep. 27, 2012

(51) Int. Cl.
*F01D 5/08* (2006.01)

(52) U.S. Cl.
USPC ..... 415/116; 416/97 R

(58) Field of Classification Search
USPC ..... 415/115, 116; 416/96 A, 97 R, 215, 416/219 R
See application file for complete search history.

(56) References Cited

U.S. PATENT DOCUMENTS 2,858,103 A * 10/1958 Waugh ..... 416/97 R
3,429,557 A 6/1966 Brandon et al.
4,094,615 A * 6/1978 Glenn ..... 416/215
4,551,063 A 11/1985 Raschke et al.
5,795,130 A * 8/1998 Suenaga et al. ..... 416/95
7,086,828 B2 8/2006 Haje et al.
7,101,144 B2 9/2006 Haje et al.
7,488,153 B2 2/2009 Reigl
2013/0028750 A1* 1/2013 Dombek et al. ..... 416/90 R

* cited by examiner

*Primary Examiner* — Nathaniel Wiehe
*Assistant Examiner* — Woody A Lee, Jr.
(74) *Attorney, Agent, or Firm* — Hoffman Warnick LLC; Ernest G. Cusick

(57) ABSTRACT

In one embodiment, an insert for a turbine cooling circuit includes: a radial cooling passage for receiving downstream fluid; an axial passage extending from the radial cooling passage within a lower portion of the insert; and a plurality of radial passages extending from the axial passage, each radial passage extending to a bottom of a partially circumferential dovetail slot of the insert. In another embodiment, an insert for a turbine cooling includes: a plurality of radial passages, each radial passage extending from a bottom of a partially circumferential dovetail slot of the insert; an axial passage extending from the plurality of radial passages within a lower portion of the insert; and an exhaust passage extending from the axial passage.

14 Claims, 7 Drawing Sheets

INSERTS FOR TURBINE COOLING CIRCUIT

BACKGROUND OF THE INVENTION

The subject matter disclosed herein relates generally to turbines. More specifically, the present disclosure related to inserts for a cooling circuit of a turbine system, such as a steam turbine.

Steam turbine systems rely on high steam temperatures in order to operate at peak efficiency. However, high steam temperatures, in combination with centrifugally-induced rotor stress, cause the rotor material to creep. Temperature-resistant rotor materials may be used to construct the drum rotor, but, unfortunately, the use of such materials significantly increases the cost of constructing the drum rotor. Effectively cooling the drum rotor during operation may extend the life of the drum rotor, without increasing the manufacturing cost.

BRIEF DESCRIPTION OF THE INVENTION

Aspects of the invention provide for inserts for a cooling circuit of a turbine system. In one embodiment, aspects of the invention include an insert for a turbine cooling circuit, the insert comprising: a radial cooling passage for receiving downstream fluid; an axial passage extending from the radial cooling passage within a lower portion of the insert; and a plurality of radial passages extending from the axial passage, each radial passage extending to a bottom of a partially circumferential dovetail slot of the insert. In another embodiment, aspects of the invention include an insert for a turbine cooling circuit, the insert comprising: a plurality of radial passages, each radial passage extending from a bottom of a partially circumferential dovetail slot of the insert; an axial passage extending from the plurality of radial passages within a lower portion of the insert; and an exhaust passage extending from the axial passage.

A first aspect of the invention provides an insert for a turbine cooling circuit, the insert comprising: a radial cooling passage for receiving downstream fluid; an axial passage extending from the radial cooling passage within a lower portion of the insert; and a plurality of radial passages extending from the axial passage, each radial passage extending to a bottom of a partially circumferential dovetail slot of the insert.

A second aspect of the invention provides an insert for a turbine cooling circuit, the insert comprising: a plurality of radial passages, each radial passage extending from a bottom of a partially circumferential dovetail slot of the insert; an axial passage extending from the plurality of radial passages within a lower portion of the insert; and an exhaust passage extending from the axial passage.

A third aspect of the invention provides an apparatus, comprising: a rotor; a stator substantially surrounding the rotor; a delivery insert within a first axial dovetail slot of the rotor, the delivery insert comprising: a radial cooling passage for receiving downstream fluid; an axial passage extending from the radial cooling passage within a lower portion of the delivery insert; and a plurality of radial passages extending from the axial passage, each radial passage extending to a bottom of a partially circumferential dovetail slot of the delivery insert; and an exhaust insert within a second axial dovetail slot of the rotor, the exhaust insert comprising: a plurality of radial passages, each radial passage extending from a bottom of a partially circumferential dovetail slot of the exhaust insert; an axial passage extending from the plurality of radial passages within a lower portion of the exhaust insert; and an exhaust passage extending from the axial passage.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 1:
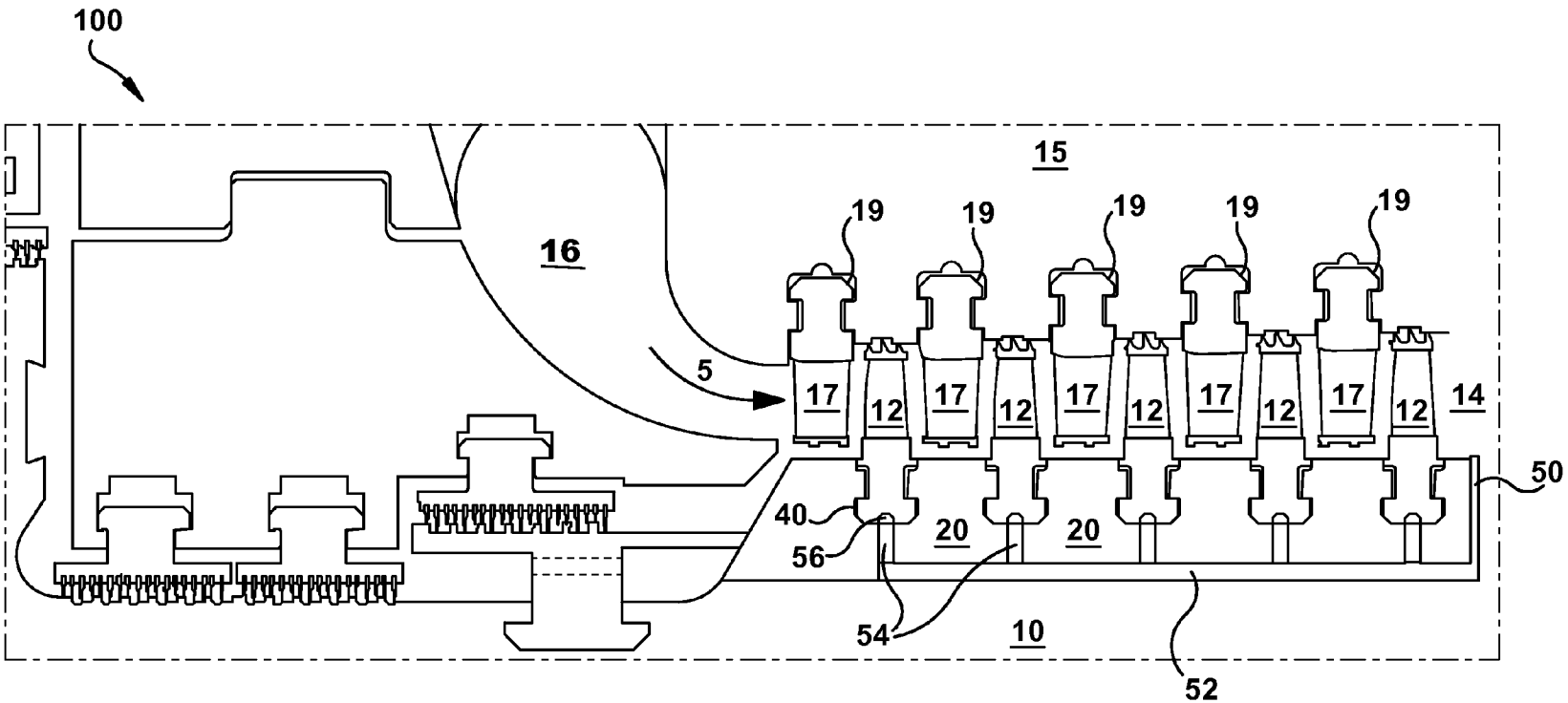
FIG. 1 shows a partial cross-sectional view of a steam turbine system according to an embodiment of the invention.

Turning to FIG. 1, a partial cross-sectional view of a turbine system 100 according to embodiments of the invention is shown. As used herein, the example of a steam turbine will be used herein to describe aspects of the invention. It is understood that a steam turbine is merely one example of a turbine system to which the teachings of the invention may be applied. In any case, use of the term "steam turbine" does not limit the teachings of the invention to such specific types of machines.

Steam turbine 100 may include a drum rotor 10 (partially shown in FIG. 1) and a stator 15 (partially shown in FIG. 1) substantially surrounding drum rotor 10. Drum rotor 10 includes at least one substantially circumferential dovetail slot 40 along its outer circumference. A bucket 12 is secured within at least one substantially circumferential dovetail slot 40. Drum rotor 10 may include a plurality of buckets 12 and a plurality of substantially circumferential dovetail slots 40. If drum rotor 10 includes plurality of buckets 12, as seen in FIG. 1, each bucket 12 is secured within a substantially circumferential dovetail slot 40.

Stator 15 includes at least one nozzle 17 secured within a nozzle slot 19. As seen in FIG. 1, stator 15 may include a plurality of nozzles 17 and each nozzle 17 may be secured within nozzle slots 19. Nozzles 17 and buckets 12 may radially extend respectively from stator 15 and drum rotor 10, such that nozzles 17 and buckets 12 are interspersed along an axial length of steam turbine 100. A fluid, such as steam, may be directed to a downstream location 14, along primary flowpath 5, to urge the rotation of rotor 10.

Figure 2:
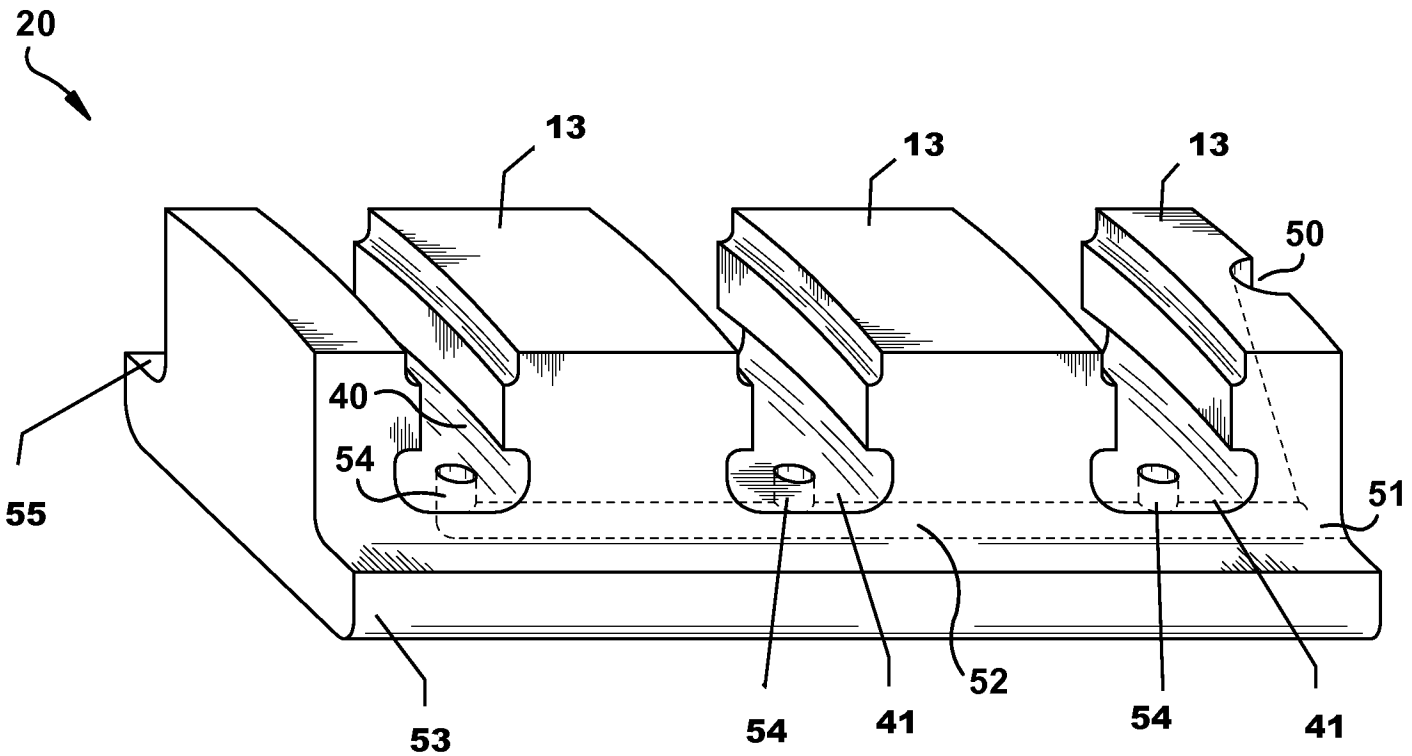
FIG. 2 shows a perspective view of a delivery insert according to an embodiment of the invention.
Figure 3:
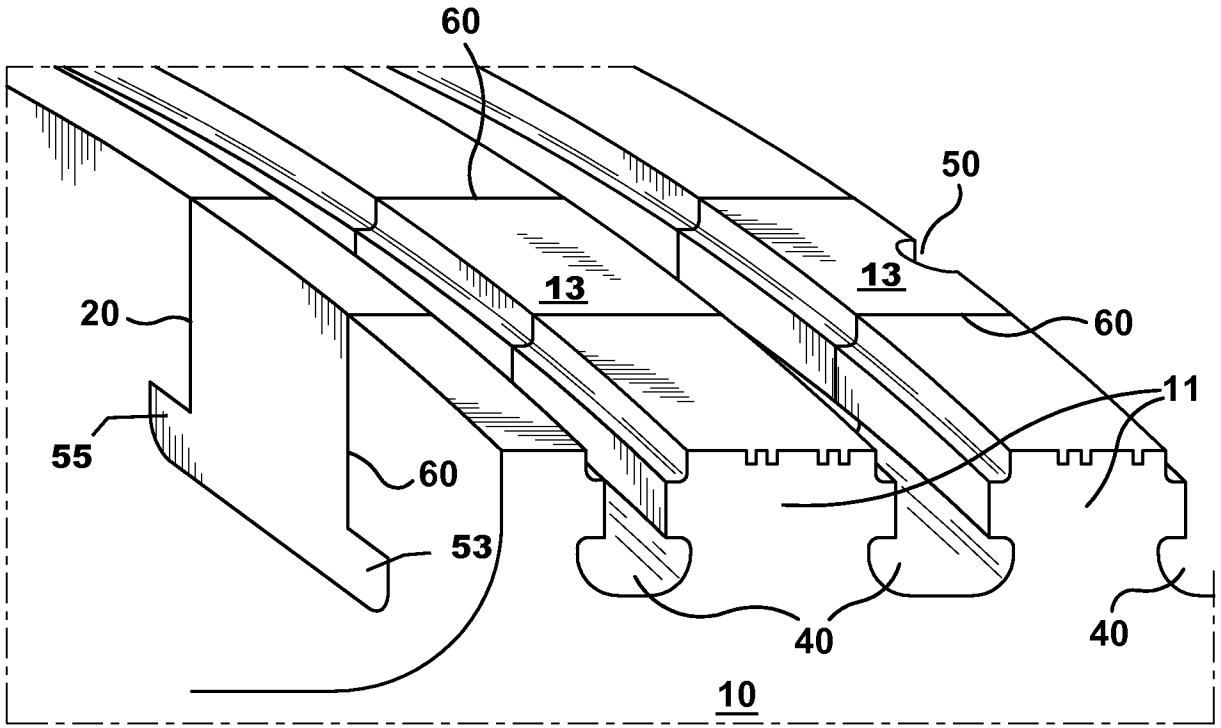
FIG. 3 shows a partial perspective view of a rotor including a delivery insert according to an embodiment of the invention.

Referring now to FIGS. 1-3, according to an embodiment of the invention, steam turbine 100 may include a delivery insert 20. As mentioned above, FIG. 1 shows a partial cross-section view of steam turbine 100 according to an embodiment of the invention. FIG. 2 shows a perspective view of delivery insert 20 according to an embodiment of the invention. FIG. 3 shows a partial perspective view of rotor 10 including delivery insert 20 according to an embodiment of the invention.

As seen best in FIG. 2, delivery insert 20 includes a radial cooling passage 50. Radial cooling passage 50 receives downstream fluid from downstream location 14 (FIG. 1). Radial cooling passage 50 is within a rotor projection 13 of delivery insert 20. Delivery insert 20 also includes an axial passage 52 and a plurality of radial passages 54. Axial passage 52 is within a lower portion 51 of delivery insert 20 and extends from radial cooling passage 50. Plurality of radial passages 54 extend from axial passage 52, along the entire length of axial passage 52. Plurality of radial passages 54 extend to a bottom of a partially circumferential dovetail slot 41 within delivery insert 20. Although delivery insert 20 is shown only including three radial passages 54, delivery insert 20 may include any number of radial passages 54 along the length of delivery insert 20.

Turning to FIG. 3, drum rotor 10 may include a first axial dovetail slot 60. Delivery insert 20 is configured to insert into first axial dovetail slot 60 within drum rotor 10. First axial dovetail slot 60 may be within each rotor projection 11. Rotor projections 11 radially extend from drum rotor 10 to form substantially circumferential dovetail slots 40. Delivery insert 20 is inserted into first axial dovetail slot 60 of drum rotor 10, such that partially circumferential dovetail slot 41 of delivery insert 20 aligns with substantially circumferential dovetail slot 40 of drum rotor 10, i.e., forming a single circumferential dovetail slot 40. Similarly, delivery insert 20 may be inserted such that rotor projections 11 of rotor 10 are aligned with rotor projections 13 of delivery insert 20, i.e., forming a single rotor projection 11.

As best seen in FIGS. 2-3, delivery insert 20 includes a first retaining edge 53 and a second retaining edge 55 within the lower portion of delivery insert 20. First retaining edge 53 and second retaining edge 55 retain delivery insert 20 within first axial dovetail slot 60.

In operation, as seen in FIG. 1, downstream fluid from downstream location 14, which is cooler than fluid at an upstream location 16, will flow down radial cooling passage 50 and into axial passage 52. Then, the fluid will flow up through plurality of radial passages 54 to a bottom of circumferential dovetail slot 40. Bottom of circumferential dovetail slot 40 includes a circumferential passage 56, such that the downstream fluid will flow around drum rotor 10, thereby cooling drum rotor 10. Delivery insert 20 cools drum rotor 10 axially (through axial passage 52), radially (through radial passages 54), and circumferentially (through circumferential passages 56).

Figure 4:
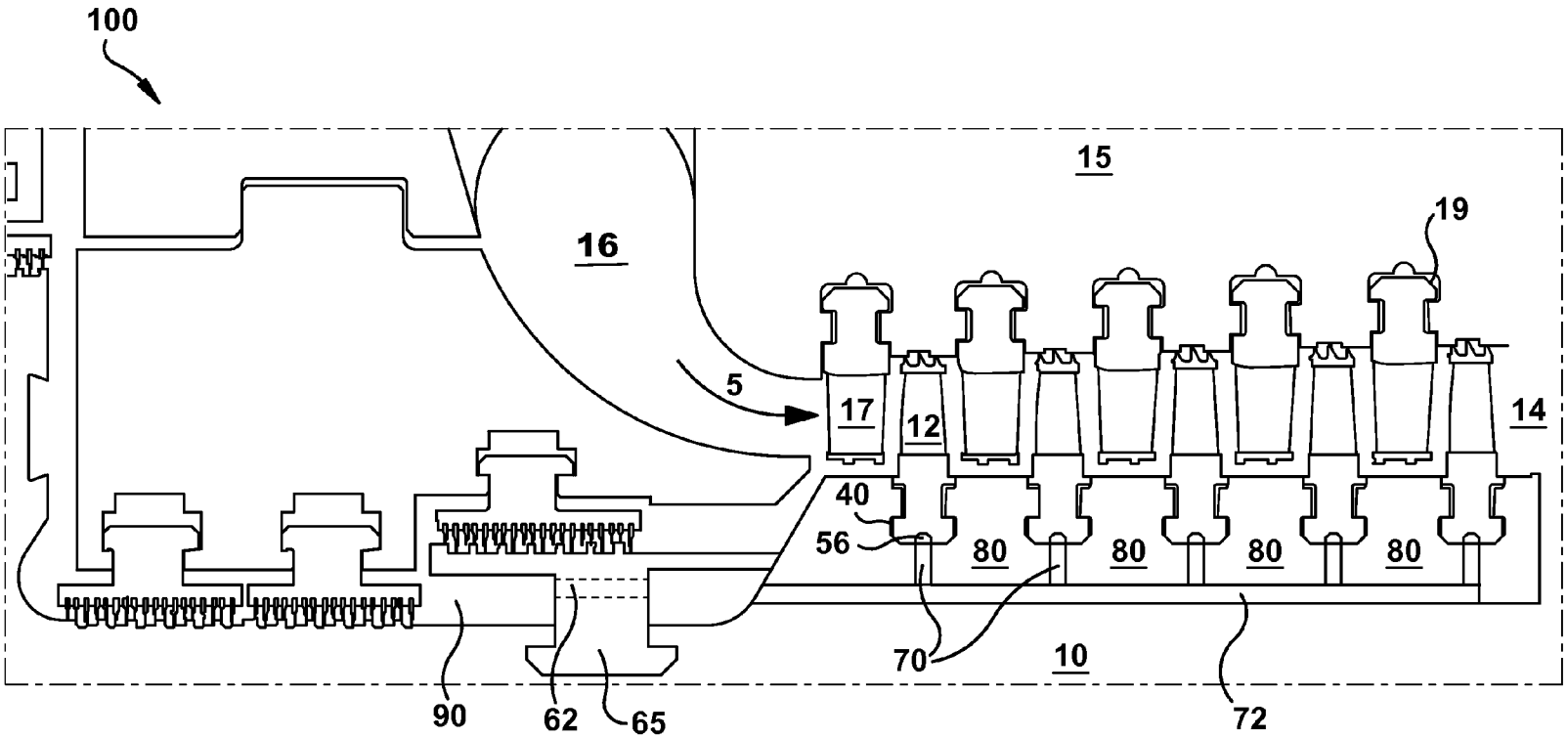
FIG. 4 shows a partial cross-sectional view of a steam turbine system according to an embodiment of the invention.
Figure 5:
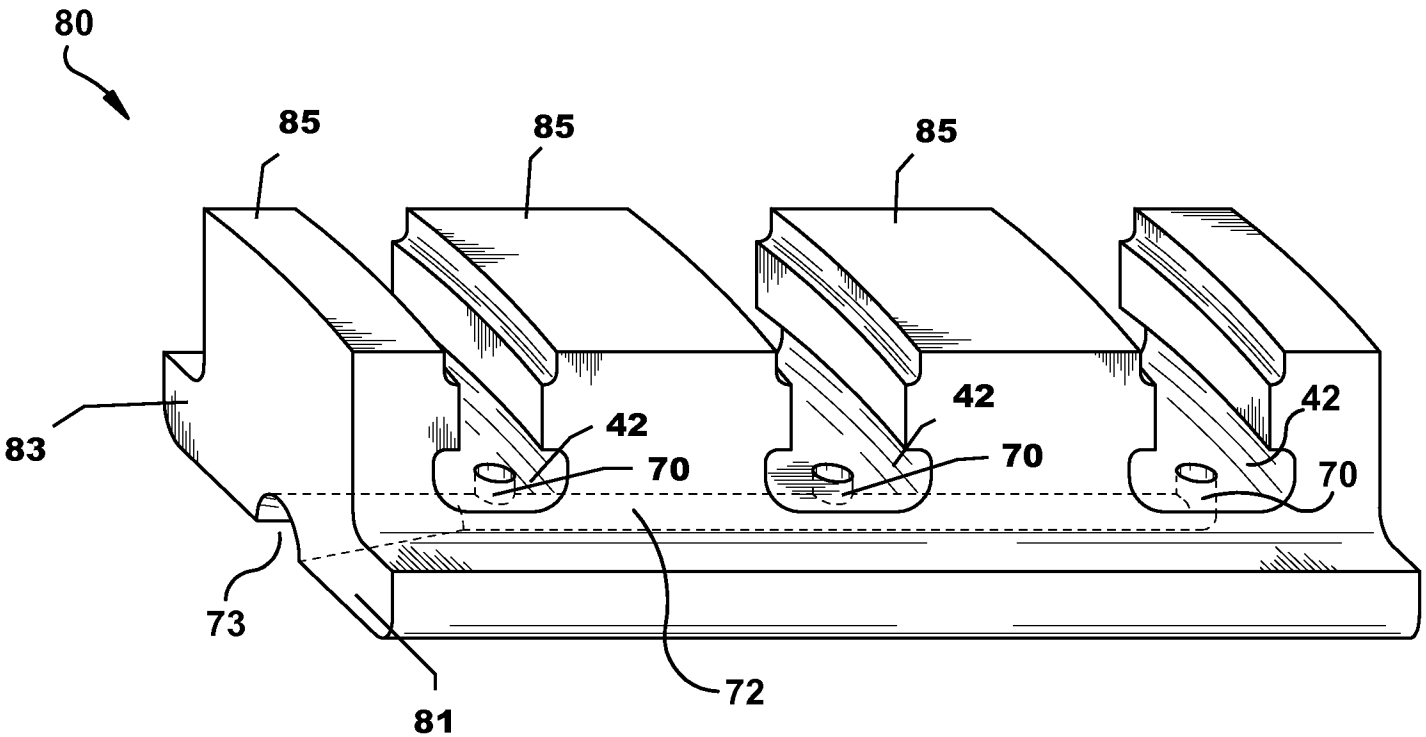
FIG. 5 shows a perspective view of an exhaust insert according to an embodiment of the invention.
Figure 6:
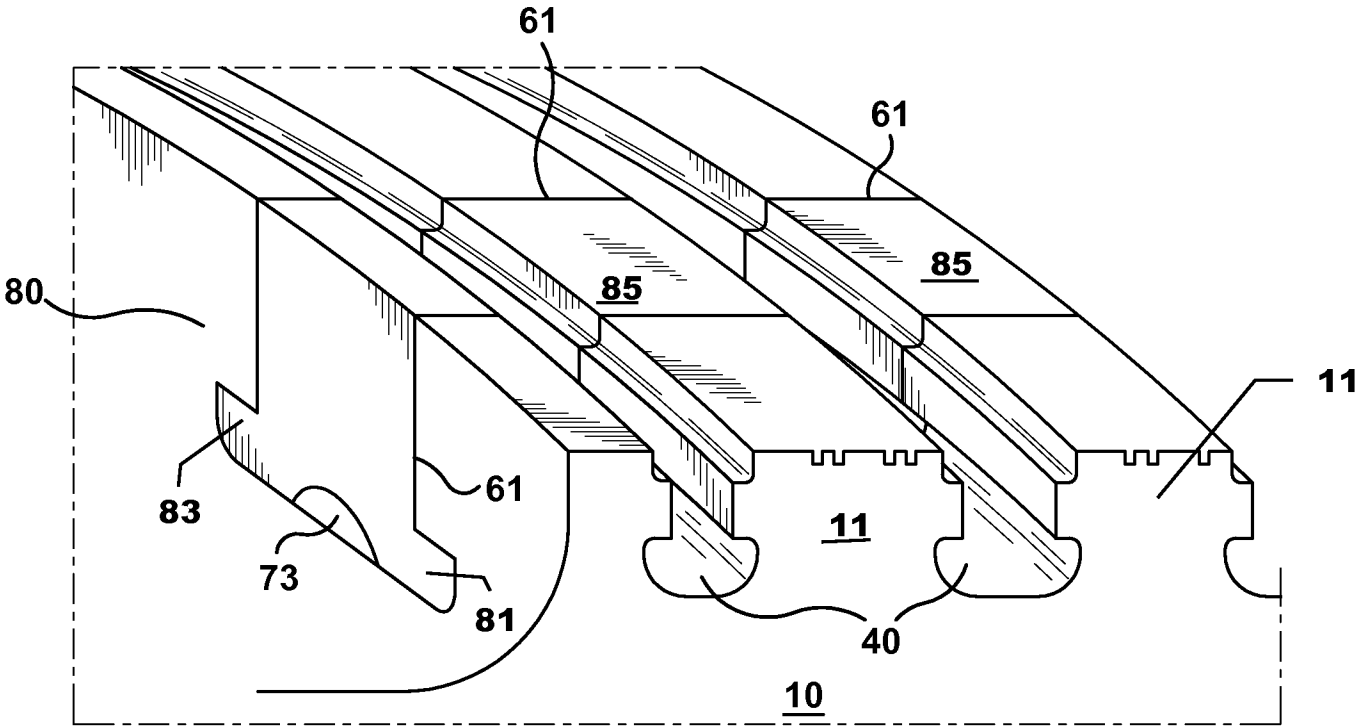
FIG. 6 shows a partial perspective view of a rotor including an exhaust insert according to an embodiment of the invention.

Referring now to FIGS. 4-6, according to an embodiment of the invention, steam turbine 100 may include an exhaust insert 80. FIG. 4 shows a partial cross-sectional view of steam turbine 100 according to an embodiment of the invention. FIG. 5 shows a perspective view of exhaust insert 80 according to an embodiment of the invention. FIG. 6 shows a partial perspective view of drum rotor 10 including exhaust insert 80 according to an embodiment of the invention.

As best seen in FIG. 5, exhaust insert 80 includes a plurality of radial passages 70. Each radial passage 70 extends from a bottom of a partially circumferential dovetail slot 42 of exhaust insert 80. Exhaust insert 80 also includes an axial passage 72 and an exhaust passage 73. Axial passage 72 extends from plurality of radial passages 70 along the length of exhaust insert 80 and within a lower portion of exhaust insert 80. Exhaust passage 73 extends from axial passage 72. Although exhaust insert 80 is shown only including three radial passages 70, it is understood that exhaust insert 80 may include any number of radial passages 80 along the length of exhaust insert 80. Further, exhaust insert 80 may include a plurality of rotor projections 85.

Turning to FIG. 6, drum rotor 10 may include a second axial dovetail slot 61. Exhaust insert 80 is configured to insert into second axial dovetail slot 61 within drum rotor 10. Second axial dovetail slot 61 may be within each rotor projection 11 of drum rotor 10. As mentioned above, rotor projections 11 radially extend from drum rotor 10 to form substantially circumferential dovetail slots 40. Exhaust insert 80 is inserted into second axial dovetail slot 61 of drum rotor 10, such that partially circumferential dovetail slot 42 of exhaust insert 80 aligns with substantially circumferential dovetail slot 40 of drum rotor 10, i.e., forming a single circumferential dovetail slot 40. Similarly, exhaust insert 80 may be inserted such that rotor projections 11 of rotor 10 are aligned with rotor projections 85 of exhaust insert 80, i.e., forming a single rotor projection 11.

As best seen in FIGS. 5-6, exhaust insert 80 includes a first retaining edge 81 and a second retaining edge 83 within the lower portion of exhaust insert 80. First retaining edge 81 and second retaining edge 83 retain exhaust insert 80 within second axial dovetail slot 61.

In operation, as seen in FIG. 4, fluid that already cooled drum rotor 10 through circumferential passages 56 will flow down plurality of radial passages 70 and into axial passage 72. Then, the fluid will flow through exhaust passage 73. From exhaust passage 73, the fluid may flow into a lower pressure sink 90 at an upstream position. The fluid exhausted into lower pressure sink 90 may first flow through a seal ring hole 62 of seal ring 65.

Figure 7:
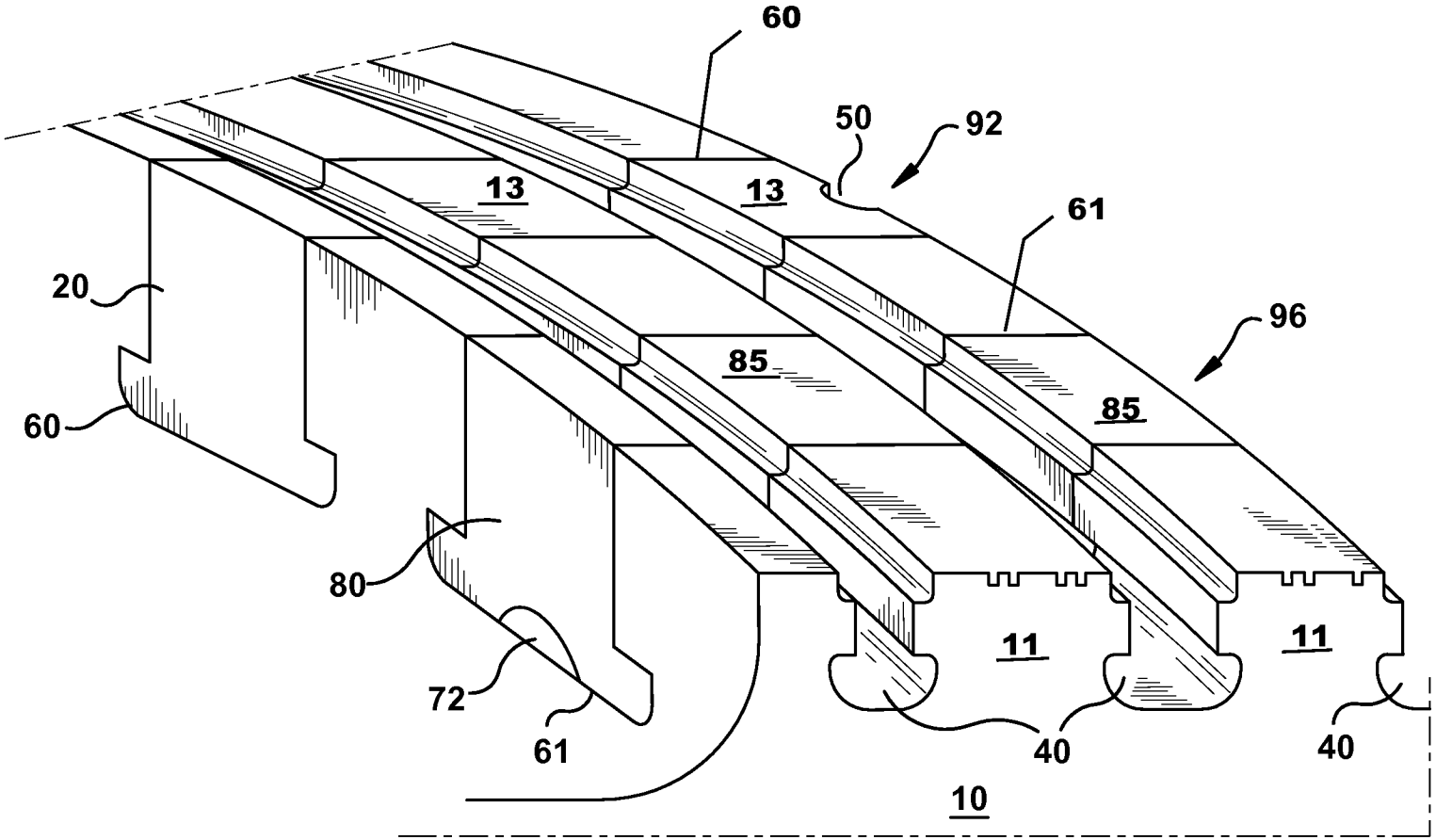
FIG. 7 shows a partial perspective view of a rotor including a delivery insert and an exhaust insert according to an embodiment of the invention.

Turning now to FIG. 7, a partial perspective view of drum rotor 10 including delivery insert 20 and exhaust insert 80 according to an embodiment of the invention is shown. Delivery insert 20 may be inserted into first axial dovetail slot 60 and exhaust insert 80 may be inserted into second axial dovetail slot 61. First axial dovetail slot 60 is at a first circumferential position 92 around drum rotor 10 and second axial dovetail slot 61 is at a second circumferential position 96 around drum rotor 10. In this embodiment, delivery insert 20 and exhaust insert 80 form a complete turbine cooling circuit for receiving cool, downstream fluid (through delivery insert 20) and exhausting the fluid (through exhaust insert 80) after the fluid has cooled drum rotor 10.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An insert for a turbine cooling circuit, the insert comprising:

at least one rotor projection configured to align with at least one rotor projection of a rotor;

a radial cooling passage for receiving downstream fluid, wherein the radial cooling passage is within the at least one rotor projection of the insert;

an axial passage extending from the radial cooling passage within a lower portion of the insert; and a plurality of radial passages extending from the axial passage, each radial passage extending to a bottom of a partially circumferential dovetail slot of the insert.

2. The insert of claim 1, wherein the insert includes a first retaining edge and a second retaining edge at the lower portion of the insert for retaining the insert within an axial dovetail slot of a rotor.

3. The insert of claim 1, wherein the partially circumferential dovetail slot of the insert is configured to align with a substantially circumferential dovetail slot of the rotor.

4. An insert for a turbine cooling circuit, the insert comprising:

at least one rotor projection configured to align with at least one rotor projection of a rotor;

a plurality of radial passages, each radial passage extending from a bottom of a partially circumferential dovetail slot of the insert;

an axial passage extending from the plurality of radial passages within a lower portion of the insert; and an exhaust passage extending from the axial passage, wherein the exhaust passage axially extends within the lower portion of the insert.

5. The insert of claim 4, wherein the insert includes a first retaining edge and a second retaining edge at the lower portion of the insert for retaining the insert within an axial dovetail slot of a rotor.

6. The insert of claim 4, wherein the partially circumferential dovetail slot of the insert is configured to align with a substantially circumferential dovetail slot of the rotor.

7. The insert of claim 4, wherein the exhaust passage exhausts fluid into a low pressure sink at an upstream position.

8. An apparatus, comprising:

a rotor;

a stator substantially surrounding the rotor;

a delivery insert within a first axial dovetail slot of the rotor, the delivery insert comprising:

a radial cooling passage for receiving downstream fluid;

an axial passage extending from the radial cooling passage within a lower portion of the delivery insert; and a plurality of radial passages extending from the axial passage, each radial passage extending to a bottom of a partially circumferential dovetail slot of the delivery insert; and an exhaust insert within a second axial dovetail slot of the rotor, the exhaust insert comprising:

a plurality of radial passages, each radial passage extending from a bottom of a partially circumferential dovetail slot of the exhaust insert;

an axial passage extending from the plurality of radial passages within a lower portion of the exhaust insert; and an exhaust passage extending from the axial passage;

wherein the delivery insert and the exhaust insert each include at least one rotor projection configured to align with at least one rotor projection of a rotor; and wherein the partially circumferential dovetail slot of the delivery insert and the partially circumferential dovetail slot of the exhaust insert are configured to align with a substantially circumferential dovetail slot of the rotor.

9. The apparatus of claim 8, wherein the delivery insert includes a first retaining edge and a second retaining edge at the lower portion of the delivery insert for retaining the delivery insert within the first axial dovetail slot of a rotor.

10. The apparatus of claim 8, wherein the exhaust insert includes a first retaining edge and a second retaining edge at the lower portion of the exhaust insert for retaining the exhaust insert within the second axial dovetail slot of a rotor.

11. The apparatus of claim 8, wherein the first axial dovetail slot of the rotor is at a first circumferential position and the second axial dovetail slot of the rotor is at a second circumferential position.

12. The apparatus of claim 8, wherein the radial cooling passage is within the at least one rotor projection of the delivery insert.

13. The apparatus of claim 8, wherein the exhaust passage axially extends within the lower portion of the exhaust insert.

14. The apparatus of claim 8, wherein the exhaust passage exhausts fluid into a low pressure sink at an upstream position.

* * * * *